United States Patent [19]

Vedenpää

[11] Patent Number: 4,513,517

[45] Date of Patent: Apr. 30, 1985

[54] CYLINDER DRYER FOR PAPER MACHINE OR EQUIVALENT

[75] Inventor: Timo Vedenpää, Jyväskylä, Finland

[73] Assignee: Valmet Oy, Finland

[21] Appl. No.: 336,360

[22] PCT Filed: May 8, 1981

[86] PCT No.: PCT/FI81/00030

§ 371 Date: Dec. 21, 1981

§ 102(e) Date: Dec. 21, 1981

[87] PCT Pub. No.: WO81/03351

PCT Pub. Date: Nov. 26, 1981

[51] Int. Cl.[3] ..... F26B 13/08

[52] U.S. Cl. ..... 34/114; 34/116; 34/117; 34/120; 226/91; 226/97

[58] Field of Search ..... 34/114, 116, 117, 120, 34/123; 226/91, 97

[56] References Cited

U.S. PATENT DOCUMENTS

| | | | |
|---|---|---|---|
| 1,605,067 | 11/1926 | Read | 34/120 |
| 2,081,945 | 6/1937 | Massey et al. | 34/120 |
| 3,089,252 | 5/1963 | Daane et al. | 34/114 |
| 3,174,228 | 3/1965 | Smith | 34/114 |
| 3,199,219 | 8/1965 | Brauer | 34/120 |
| 3,570,136 | 3/1971 | Hakanson | 34/114 |
| 3,707,743 | 1/1973 | Marchal | 34/120 |
| 3,783,526 | 1/1974 | Fleissner | 34/120 |
| 3,827,639 | 8/1974 | Relue et al. | 34/156 |
| 3,930,319 | 1/1976 | Coleman | 34/114 |
| 4,000,035 | 12/1976 | Schiel et al. | 34/117 |
| 4,014,740 | 3/1977 | Koponen et al. | 34/120 |
| 4,124,941 | 11/1978 | Birke et al. | 34/114 |
| 4,172,007 | 10/1979 | Kankaanpää34 | 117/ |
| 4,183,148 | 1/1980 | Koski et al. | 34/116 |
| 4,190,964 | 3/1980 | Schiel | 34/114 |
| 4,202,113 | 5/1980 | Kankaapää34 | 116/ |

FOREIGN PATENT DOCUMENTS

| | | |
|---|---|---|
| 2355397 | 6/1974 | Fed. Rep. of Germany . |
| 2829209 | 1/1979 | Fed. Rep. of Germany . |
| 138774 | 11/1978 | Norway . |
| 196703 | 6/1965 | Sweden . |
| 404047 | 1/1979 | Sweden . |
| 410348 | 10/1979 | Sweden . |

*Primary Examiner*—Larry I. Schwartz
*Assistant Examiner*—David W. Westphal
*Attorney, Agent, or Firm*—Steinberg & Raskin

[57] ABSTRACT

Cylinder dryer for a paper machine comprising a plurality of drying cylinders (10,20). The paper web and its lead strip are conducted between said cylinders (10,20) supported by a fabric (11). For guiding through the cylinder dryer the lead strip (L) having a width of a smaller order of magnitude than the normal width of the web (W), an air blowing means has been arranged adjacent to the drying cylinder and the free draws thereinbetween. Said air blowing means urges the web lead strip against the surface of the supporting fabric (11) or the cylinder. Said blowing means has substantially the same width as the lead strip and it carries a plurality of nozzles holes (14), through which air jets ($F_1$,$F_2$) are directed against the web. The covering angle of said air blowing means substantially equals that angle ($\beta$) on which the web supporting fabric (11) and the web (W) on its outside change direction.

21 Claims, 10 Drawing Figures

FIG. 1
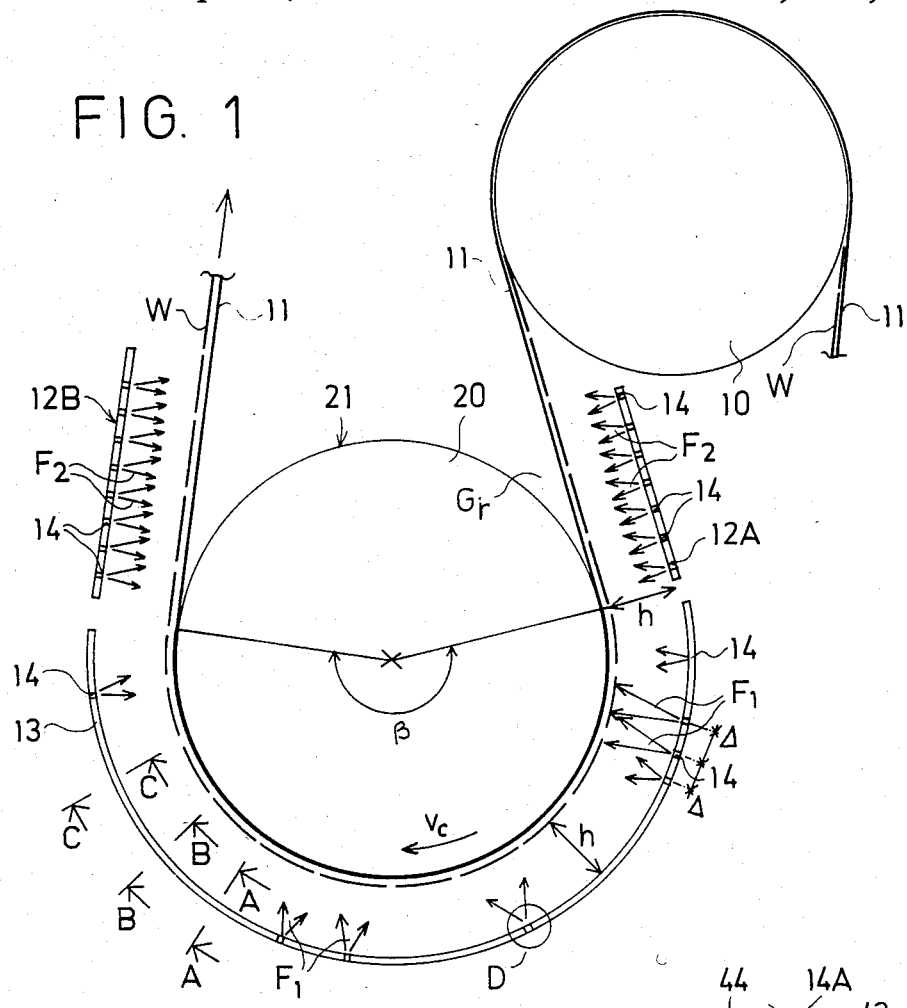
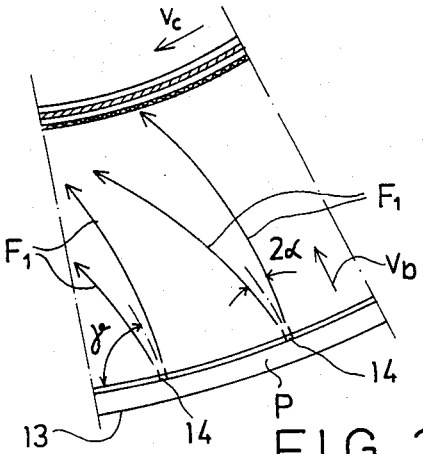
FIG. 2
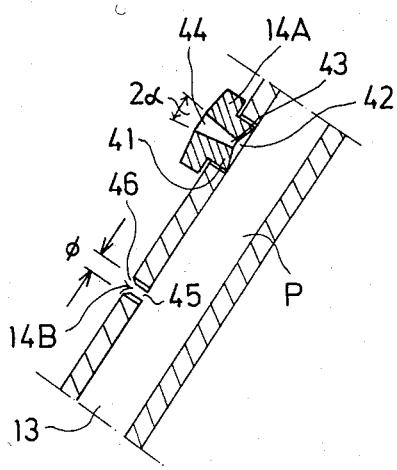
FIG. 3

FIG. 4A
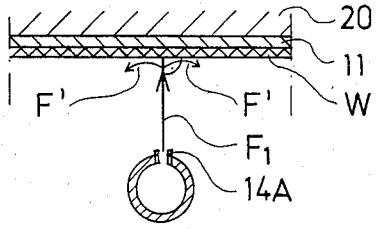
FIG. 4B
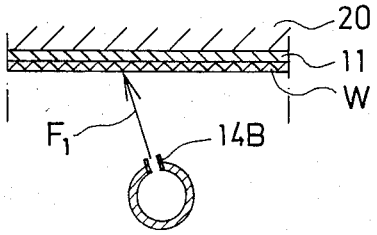
FIG. 4C
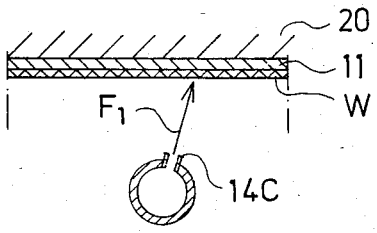
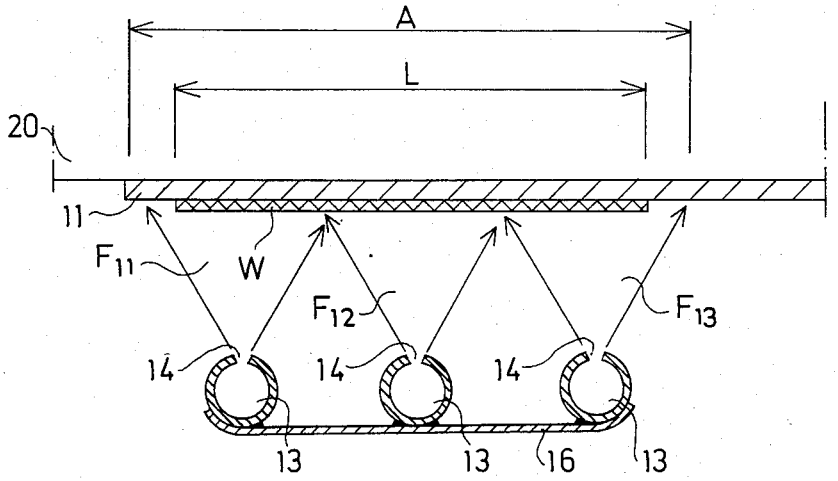
FIG. 5

CYLINDER DRYER FOR PAPER MACHINE OR EQUIVALENT

BACKGROUND OF THE INVENTION

The present invention concerns a cylinder dryer for a paper machine or equivalent, consisting of a plurality of drying cylinders or equivalent rolls, between which the web and its lead strip is conducted, preferably supported by a fabric.

The main object of the invention is to provide a cylinder dryer of the kind above defined and wherein the web threading operation has been ensured, in particular when applying single-felt conduction or the like.

As known in prior art, a conventional rope carrier has been employed in association with single felt conduction. Since as a rule the rope grooves on the drying cylinders have a depth exceeding the thickness of the carrier ropes minus the felt thickness, the ropes and the felt edge will cross, whereby in the threading situation the edge strip shaped from the web may be broken up. Another drawback arising from the crossing of ropes and felt is the tendency of the ropes to fall off, which happens if the felt is carried towards the machine operator's side.

The web threading procedures of prior art based on the use of ropes, bands etc. are embarassed by a remarkable detriment owing to the falling off, damage or rupture of the rope, band or equivalent, or owing to failure of the equipment guiding these elements.

It has been suggested in certain threading procedures and apparatus of prior art to apply differential pressure (vacuum in the first place) to steady the web on the cylinders and to increase the evaporation during the run; and in this respect reference is made to the same applicant's earlier U.S. Pat. Nos. 4,183,148, 4,172,007 and 4,202,113 and to the U.S. Pat. No. 4,190,964 by J. M. Voith.

It is furthermore known in the art to utilize the so-called Coanda effect in the threading operation in the group interspace between the drying cylinders. But in order to serve its purpose, this procedure must detach the web and take it along, with the consequence that when applied within a group it leaves the web slack. When the aim is to achieve a fully closed conduction from the press section to the dryer, this advantage is lost if the end is threaded in the normal manner, because it becomes necessary to detach the web from the fabric supporting it.

Moreover, when the web is carried to one side, the web must move faster in order that the velocity component in the web direction might be constant, the transformation coefficient being $1/\cos \alpha$, where $\alpha$ is the deflection angle. As a rule, there is tension between the press and the first drying group, i.e., a positive differential speed in the direction of travel of the web, implying that on the draw in question the elongation E caused in the paper increases to be $E/\cos \alpha$ as long as the threading process is in progress. This tends to favour web breaks. Moreover, when the web is carried to one side, other stresses are also produced in the web, increasing the risk of rupture of the lead strip.

It has also been suggested in the art to improve the web threading process by using a band that is conducted upon the web. This implies that extra equipment is used, and it is also accompanied by the detriments associated with the guiding and lateral moving of the band and with falling off and rupture, and with multiple folding. Reference is made in this respect to the U.S. Pat. No. 4,000,035 (J. M. Voith).

The web threading process usually requires manual operation, such as the use of blow tubes, and in which work steps a remarkable risk of accidents is present.

It is further known in the art to use subatmospheric pressure (vacuum) for keeping the web adherent in connection with a running mode as has been said. It is essential in these problem solutions known in the art, that in connection with the threading process on the surface of the cylinder/roll opening to the free space immediately in front of the end the subatmospheric pressure tends to discharge, whereby the end is detached from the felt, whereafter the suction in the region in question has no longer any substantial effect.

When the web that is being threaded has become detached, the stresses arising from air resistance and centrifugal force will also increase, impeding the threading operation, which may even fail totally. In this connection reference is made to the same applicant's Finnish patent application No. 793643.

SUMMARY OF THE INVENTION

With a view to avoiding the drawbacks pointed out, and achieving the objects of the invention, the invention is mainly characterized in that to the purpose of guiding through the cylinder dryer a lead strip which has a width of a smaller order of magnitude compared with the normal web width, there has been disposed adjacent to the drying cylinder, or cylinders, and/or the free draws thereinbetween, a means urging the web lead strip against the supporting fabric or the cylinder surface, this means consisting of one or several air blowing means with a width substantially equalling that of the lead strip and having a plurality of nozzle holes, through which air jets are directed against the web.

BRIEF DESCRIPTION OF THE DRAWINGS

The invention is described in the following in detail, with reference being made to an embodiment example, presented in the figures of the attached drawing, to the details of which the invention is not confined.

FIG. 1 presents, in schematical elevational view, a cylinder dryer according to the invention.

FIG. 2 shows the detail "D" in FIG. 1, on an enlarged scale.

FIG. 3 shows two different nozzle alternatives of the means of the invention.

In FIGS. 4A,4B and 4C have been shown some alternative orientations of the nozzle of the tubular arc; at the same time these figures represent e.g. the sections A—A;B—B;C—C in FIG. 1.

In FIG. 5 is shown a three-row tubular arc means according to the invention.

DETAILED DESCRIPTION OF PREFERRED EMBODIMENTS

Figure 6:
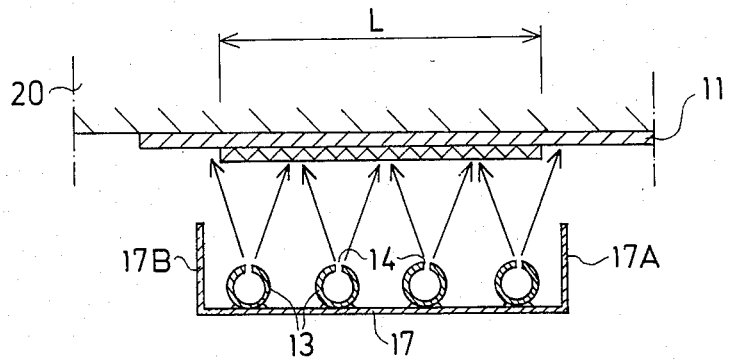
In FIG. 6 is shown a four-row tubular arc means, of which the nozzle tubes have a box-type tube member.

As shown in FIG. 1, the threading means of the invention has been fitted for instance on the first drying cylinder group, or several such groups, of a multiple cylinder dryer. As shown in FIG. 1, for conduction of the web W is used a felt 11, whereby there are no free unsupported draws between the cylinders 10 in the upper row and the cylinders 20 of the lower row. However, the invention may in some instances be applied also without using any supporting fabric 11 or equivalent. The web is then unsupported between the top and bottom cylinder rows, and then no general lower felt is either used in this design. On the other hand, a so-called upper felt can be used.

As shown in FIG. 1, there has been arranged on that run where the felt 11 and the web W carried thereby transfer from one drying cylinder 10 to another cylinder 20, a blowing means 12A, which has a width equalling that of the lead strip of the web W. A similar blowing means 12B has been provided on that run of web W and felt 11 where they separate from the cylinder 20. The cylinders 10 and 20 are, for instance, normal steam-heatable drying cylinders with smooth surface 21. The means 12A and 12B are rectilinear and they have been disposed on the rectilinear run of web and felt 11 with constant spacing h from the outer surface of the web W (of the lead strip). Between the said rectilinear blowing means 12A and 12B has also been placed a blow arc means having a width equalling that of the lead strip of the web W and consisting in a manner that will become apparent later on, of one or several blow tubes 13 having nozzle holes 14, uniformly spaced ($\Delta$) for instance. The blow tube (or tubes) 13 are located at a constant distance h from the outer surface of the web W. The blow tube means has been placed e.g. on the arc $\beta$ where the web W and felt 11 change direction upon the drying cylinder 20. The said distance h may also vary to some extent.

In FIG. 3 are shown two alternative embodiments of the nozzles 14. In FIG. 3, the upper nozzle consists of a nozzle piece mounted e.g. by threads 41 in a hole in the nozzle tube arc 13. The nozzle piece 14A has, starting on the inside of the tube 13, an expanding initial portion 42, whereafter follows a cylindrical hole 43 having on its extension the opening, actual nozzle element 44, presenting the aperture angle $2\alpha$. The nozzle 14B also shown in FIG. 3 consists of a bore made in the wall of the arc tube 13, with a hole 45 that is, starting from the interior of tube 13, cylindrical or slightly converging, and with a nozzle element 46 presenting an appropriate aperture angle forming its extension. In FIG. 3, the diameter of the nozzle 14B has been denoted with $\phi$. Nozzles of the kind shown in FIG. 3 may also be used on the rectilinear blowing means 12A and 12B.

As shown in FIG. 1, the web W arrives, covered by the felt 11, from the drying cylinder or roll 10 and goes together with the felt 11 to the drying cylinder 20, or equivalent roll, located at lower elevation, in such manner that the web W will now be outermost.

The means of the invention is used to produce a pressure urging the lead strip of the web W against the felt 11. If the lead strip becomes detached from the felt 11, the air flow will carry it with itself and back into contiguity with the felt 11. The forces acting to press the lead strip against the felt are the dynamic pressure (Pitot pressure) from the air jets $F_1$,$F_2$ and the centrifugal pressure arising from the curvature of the jets and, on the other hand, as the air flows in the direction of the web W, the web W tends under effect of the dynamic pressure component to become detached from the felt 11 and by effect of friction forces to follow along with the air flows in the direction of the web W. This is eliminated by using an appropriate spacing h of the means 12,13 from the web W, combined with suitable nozzle spacing $\Delta$, nozzle diameter $\phi$ and supply pressure, so that the forces pressing down on the web W (the lead strip) outweigh both the forces created by the flow itself and the pressure caused by centrifugal force. $P_r = m' v^2/r$, where m' = total mass per unit area of the web, v = web velocity, and r = radius.

It should be noted, referring to FIG. 2, that one difficulty which may possibly be encountered when the present invention is being applied is the so-called air doctor phenomenon; this can be avoided by selecting a flare $\alpha$ of the nozzle 14, a blower air velocity $v_b$, distance h and running speed $v_c$ such that the component, in the direction of the web W, of the blowing velocity $v_b$ and of the velocity $v_a$ of the air going along with the web W has at every point of the lead strip a jet interface a direction coinciding with the direction of travel of the web, this being accomplished by selecting for the jet $F_1$ a suitable angle $\gamma$, which angle may vary at different points of the arc 13.

The blowing arcs 13 may have a length equalling the contact angle $\beta$ between the web W and the felt 11, or they may be shorter or longer. The means may be made of one or several parts and it may partly or entirely extend into the region where the felt 11 is not backed by the cylinder 20 or roll and where the web W follows along with the felt 11.

FIGS. 4A,4B and 4C show a few structural alternatives of the tubular arc 13. The means of the invention consists of a tube provided with appropriate nozzles at a given spacing $\Delta$, either by machining or by affixing them. As shown in FIG. 4A, the force from the nozzle acts in the plane of FIG. 4 perpendicularly on the web W, whereby the jet $F_1$ is split up into two parts F'. As shown in FIGS. 4B and 4C, the jets $F_1$ are directed slightly obliquely against the web W, whereby when impinging on the web W, the air flow is deflected and continues either as one jet or divides into two parts, depending on the initial angle and on the design of the nozzle 14B,14C.

The ways of orienting the nozzles 14A,14B,14C which have been described may be applied, depending on the application, each type alone or in combination or all three together, whereby one achieves, in the lateral direction, a wider coverage by the jets $F_1$ and a broader supporting effect.

The jet nozzle 15 of the means of FIG. 5 have been disposed in several rows, FIG. 5 showing as an example, a construction with three rows. Each row may contain one or several of the design presented in FIGS. 4A,4B and 4C.

As shown in FIG. 5, the nozzle tubes 13 have been affixed to a sheet metal piece 16 or equivalent, to a plurality of successive supporting rods as seen in the longitudinal direction of the tubes 13. As shown in FIG. 5, the width A of the joint action area of the jets $F_{11}$,$F_{12}$ and $F_{13}$ from the jet tubes 13 exceeds the width L of the lead strip of the web W. The lead strip is positioned symmetrically within the range A to greatest advantage.

As shown in FIG. 6, the four rows of tubes 13 are supported by a continuous wall 17 with borders 17A,17B, on part of the length, or the whole, of the arc $\beta$. The wall 17 may be provided on part of its length, or on its whole length, with borders 17A and 17B on either one or both sides, these walls being positioned outside the width L of the lead strip, in the immediate vicinity of its margins. The walls 17,17A and 17B reduce the amount of air induced by the blowing air to follow along and they are therefore useful, particularly immediately before the closing throat G. The pressures and flows in the individual tubes 13 are not necessary equal. For instance, the centremost tubes 13 may carry higher pressure and have smaller nozzles 14, whereby a given supporting and guiding force is achieved with a lower air flow rate. The tubes 13 may be differently shaped, for instance they may be rectangles or they may be combined of two profiled sheets.

Figure 7:
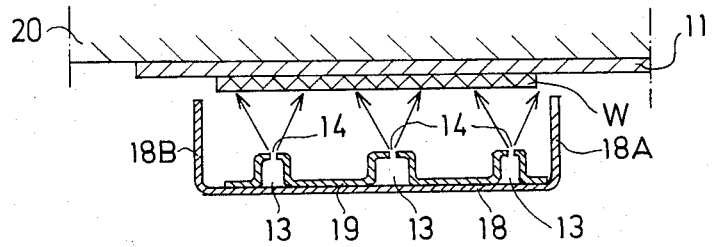
FIG. 7 shows a variant of the embodiment of FIG. 6.

FIG. 7 shows a variant of FIG 6. The nozzle tubes 13 are formed between the sheet elements 18 and 19. The sheet element 19 has been bent to a configuration such that it defines, together with the lower sheet part 18, nozzle tube ducts 13, which have been provided with nozzle holes 14 as described before. The outer sheet element has as its extension the marginal parts 18*a* and 18*b*, spaced from each other a little more than is the width of the lead strip of the web W.

Figure 8:
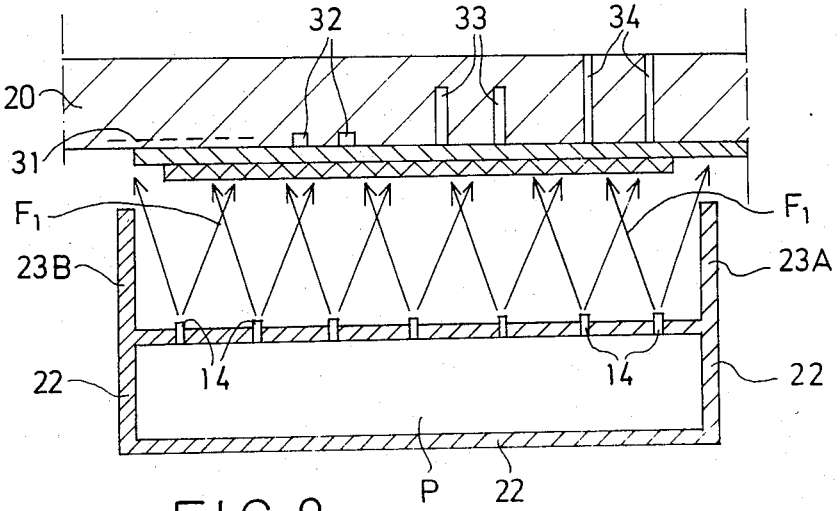
FIG. 8 shows an embodiment of the invention wherein the blow tube consists of a box-type structure.

In FIG. 8 has been illustrated an alternative apparatus construction where the frame of the means consists of a box 22, with which have been directly combined the blow holes or nozzles 14, and the box 22 also serves as a means preventing induction currents, by action of the walls 23A and 23B. The walls 23A and 23B have been appended on part of the length of the means or on its whole length.

In FIG. 8, have moreover schematically been shown some ways in which the effect of the means of the invention can be boosted, this taking place by modifying the pressure on the other side of the web W. This may be accomplished by various designs producing subatmospheric pressure (vacuum), e.g. by the aid of recessed configurations 31 of the cylinder 20 parellelling its axis, by means of peripherally running recessed configurations 32, by blind-drilled holes 33, which imply external suction means outside the sector $\beta$ (FIG. 1), or various suction roll designs 34.

In the following are stated the claims, various details of the invention being allowed to deviate from that which has been presented above, and to vary, within the scope of the invention idea expressed by these claims.

I claim:

1. In a drying section of a paper machine comprising a plurality of drying cylinders, wherein a web with a leading strip thereof is conducted over each cylinder from one cylinder to the next, the leading strip having a substantially narrower width than the web, and comprising a supporting fabric for supporting the conducted web, the improvement comprising means for urging the leading strip of the web against the fabric as it passes about at least one of the cylinders, said means comprising at least one fluid conveying means of width substantially equal to the width of the leading strip, said fluid conveying means comprising a plurality of nozzle holes through which jets of fluid are directed against the leading strip.

2. In a drying section according to claim 1, the improvement wherein said means is disposed around the cylinder over an arc along which the web and supporting fabric change direction on the outside of the cylinder.

3. In a drying section according to claim 2, the improvement wherein said means comprises additional fluid conveying means disposed for urging the leading strip against the supporting fabric along a straight run of the web and fabric between consecutive drying cylinders.

4. In a drying section of a paper machine comprising a plurality of drying cylinders, wherein a web with a leading strip thereof is conducted over each cylinder from one cylinder to the next, the leading strip having a substantially narrower width than the web, the improvement comprising means for urging the leading strip of the web against at least one of the cylinders, said means comprising at least one fluid conveying means of width substantially equal to the width of the leading strip, said fluid conveying means comprising a plurality of nozzle holes through which jets of fluid are directed against the leading strip, said urging means being mounted to be removed away from its action region after the leading strip has been guided around the cylinder.

5. In a drying section of a paper machine comprising a plurality of drying cylinders, wherein a web with a leading strip thereof is conducted over each cylinder from one cylinder to the next, the leading strip having a substantially narrower width than the web, the improvement comprising means for urging the leading strip of the web against at least one of the cylinders, said means comprising at least one fluid conveying means of width substantially equal to the width of the leading strip, said fluid conveying means comprising a plurality of nozzle holes through which jets of fluid are directed against the leading strip, said fluid conveying means being disposed as a tubular structure with a plurality of said nozzle holes disposed along a portion of said fluid conveying means facing the web, and said nozzle holes being disposed to direct fluid at an oblique angle to the width of the leading strip.

6. In a drying section of a paper machine comprising a plurality of drying cylinders, wherein a web with a leading strip thereof is conducted over each cylinder from one cylinder to the next, the leading strip having a substantially narrower width than the web, the improvement comprising means for urging leading strip of the web against at least one of the cylinders, said means comprising at least one fluid conveying means of width substantially equal to the width of the leading strip, said fluid conveying means comprising a plurality of nozzle holes through which jets of fluid are directed against the leading strip, and at least one of said nozzle holes is outwardly flared in the direction of the cylinder.

7. In a drying section of a paper machine comprising a plurality of drying cylinders, wherein a web with a leading strip thereof is conducted over each cylinder from one cylinder to the next, the leading strip having a substantially narrower width than the web, and a supporting fabric for supporting the web conducted between the plurality of drying cylinders, the improvement comprising means for urging the leading strip of the web against the fabric passing about at least one of the cylinders, said means comprising at least one first fluid conveying means of width substantially equal to the width of the leading strip, said first fluid conveying means comprising a plurality of nozzle holes through which jets of fluid are directed against the leading strip, and means for urging the leading strip of the web against the supporting fabric along at least one straight run of the fabric between consecutive drying cylinders, said means comprising at least one second fluid conveying means comprising a plurality of nozzle holes through which jets of fluid are directed against the leading strip.

8. In a drying section according to claim 7, the improvement wherein said first and second fluid conveying means are each disposed as a tubular structure with a plurality of said nozzle holes disposed along a portion of said respective first and second fluid conveying means facing the web.

9. In a drying section according to claim 8, the improvement wherein said first and second fluid conveying means each comprise a plurality of said tubular structures.

10. In a drying section according to claim 9, the improvement wherein said first and second fluid conveying means each additionally comprise supporting structure for supporting said plurality of tubular structures, said supporting structure comprising side walls extending along substantially the entire length of said tubular structure and mutually spaced from one another at a distance exceeding the width of the leading strip.

11. In a drying section according to claim 10, the improvement wherein said supporting structure is formed from a first sheet element and said tubular structures are formed by second sheet elements being shaped to engage said first sheet element, providing conduits for flowing fluid therebetween.

12. In a drying section according to claim 9, the improvement wherein said tubular structures are positioned substantially symmetrically with respect to the width of the leading strip.

13. In a drying section according to claim 8, the improvement wherein said tubular structure is shaped as a box-type beam of substantially rectangular cross-section.

14. In a drying section according to claim 13, the improvement wherein said tubular structure additionally comprises side walls extending along substantially the entire length of said tubular boxtype beam, extending past said nozzle holes and mutually spaced from one another at a distance exceeding the width of the leading strip.

15. In a drying section according to claim 8, the improvement wherein said nozzle holes are disposed to direct fluid in a direction substantially normal to the width of the leading strip.

16. In a drying section according to claim 8, the improvement wherein said nozzle holes are disposed to direct fluid at an oblique angle to the width of the leading strip.

17. In a drying section according to claim 7, the improvement wherein both said urging means are mounted to be removed away from their action region after the leading strip has been guided along the supporting fabric between the drying cylinders.

18. In a drying section according to claim 7, the improvement wherein said nozzle holes are substantially uniformly spaced from one another and are arranged at a substantially uniform distance away from the web.

19. In a drying section according to claim 7, the improvement wherein said nozzle holes are disposed to direct fluid onto the leading strip in a direction substantially parallel to the direction the leading strip passes between the cylinders.

20. In a drying section according to claim 7, the improvement wherein at least one of said nozzle holes is outwardly flared in the direction of the web.

21. In a drying section according to claim 7, the improvement wherein said fluid conveying means is air blowing means.

* * * * *